US005186359A

United States Patent [19]

Brown et al.

[11] Patent Number: 5,186,359

[45] Date of Patent: Feb. 16, 1993

[54] METHOD AND APPARATUS FOR DISPENSING FLOWABLE HAIR PRODUCTS

[76] Inventors: Donald A. Brown, 257 Royal Oak Court, Oakville, Ontario L6H 3A8; Steven P. Brown, 383 Pine Avenue, Oakville, Ontario L6J 2K2; Barbara MacDonald, 340 Sandhurst Drive, Oakville, Ontario L6L 4L2, all of Canada

[21] Appl. No.: 684,875

[22] Filed: Apr. 15, 1991

[30] Foreign Application Priority Data

Apr. 23, 1990 [CA] Canada ..... 2015175

[51] Int. Cl.[5] ..... B65D 35/22

[52] U.S. Cl. ..... 222/1; 222/93; 222/94; 222/105; 222/129; 222/183

[58] Field of Search ..... 222/94, 1, 93, 105, 222/107, 183, 129, 192

[56] References Cited

U.S. PATENT DOCUMENTS

| | | | |
|---|---|---|---|
| 2,819,723 | 1/1958 | Meyer | 222/94 X |
| 2,831,610 | 4/1958 | Dennie | 222/183 X |
| 3,221,943 | 12/1965 | Anderson | 222/183 |
| 3,227,322 | 1/1966 | Crain | 222/183 |
| 3,349,960 | 10/1967 | Ketler | 222/183 X |
| 3,371,824 | 3/1968 | Goss | 222/105 |
| 3,931,912 | 1/1976 | Hsiung | 222/94 |
| 4,739,875 | 4/1988 | Bedwell et al. | 222/105 X |
| 4,869,398 | 9/1989 | Colvin et al. | 222/105 X |
| 5,050,775 | 9/1991 | Marquardt | 222/105 X |
| 5,085,346 | 2/1992 | Wright | 222/183 X |

FOREIGN PATENT DOCUMENTS

| | | | |
|---|---|---|---|
| 2908654 | 9/1980 | Fed. Rep. of Germany | 222/105 |

*Primary Examiner*—Kevin P. Shaver

*Attorney, Agent, or Firm*—McFadden, Fincham, Marcus & Anissimoff

[57] ABSTRACT

There is disclosed a method and apparatus for dispensing bulk hair products. The method includes providing sources of hair products and flexible thermoplastic bags having integrally associated press taps for filling with the hair products. The charged bags are then hermetically sealed by any known method. In this way, a variety of hair products, particularly those susceptible to damage by exposure to air can be stored and dispensed into resealable containers. The bags are conveniently contained within a specifically designed carton formed from a blank. The carton includes a rectangular box having a partition therein and perforated areas adapted to receive the dispensing spout of the sealed bags. The carton further provides a storage area within the carton for storage of the resealable containers, gloves and other necessary supplies.

16 Claims, 8 Drawing Sheets

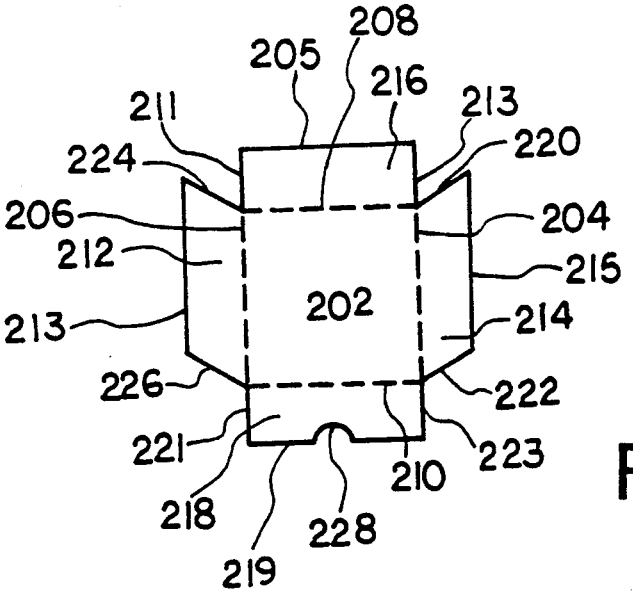
Fig. 2
Fig. 3
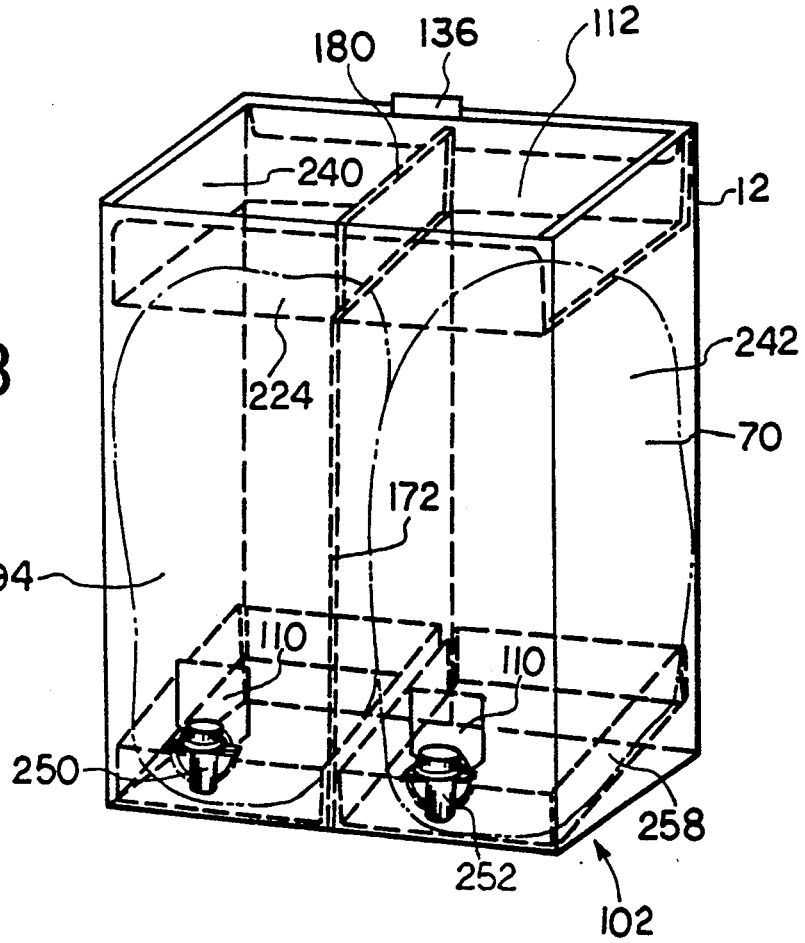

METHOD AND APPARATUS FOR DISPENSING FLOWABLE HAIR PRODUCTS

FIELD OF THE INVENTION

This invention relates to dispensing apparatus for dispensing predetermined quantities of separate bulk hair products from a single container containing the bulk sources.

In another aspect, this invention relates to a method of dispensing at least two sources of bulk hair products.

BACKGROUND OF THE INVENTION

Hair products such as chemicals used for hair permanents are normally sold in small quantities which the user will employ for a single hair permanent. Typically, the solutions used in creating a hair permanent include an acid or alkaline solution and a neutralizer. These chemicals are sensitive to various factors such as atmospheric conditions, oxygen, light, etc. so that once a container has been opened, it can normally not be used, as far as any remaining solution is concerned, at a future date.

There are various types of applications using permanent hair solutions such as beauty salons or home usage. Even in the case of beauty salons, individual small quantities of the chemicals must be used each time for the above reasons.

The packaging costs involved in preparing, shipping and using relatively minor quantities of permanent hair solutions adds significantly to the cost of such components or treatments. This is due to the extra packaging required, the extra shipping costs, etc.

In addition, under today's environmental standards, where it is desirable to avoid usage of excess packaging material, a further problem is encountered in that many of the chemicals for use in permanent hair treatments must be stored and shipped in non-breakable plastic containers.

It would be desirable if a method and apparatus were developed which significantly reduced the amount of packaging required for individual hair treatment portions without the attendant problems of having the spoilage of the products once they are opened or conversely, being able to retain excess products for future use. It is therefore an object of the present invention to provide such a method and apparatus.

A further object of the present invention, is to provide an apparatus and method which permits the dispensing of desired amounts of hair products for individual treatment but at the same time, protecting the unused contents of the hair products for future use.

In yet another object of the present invention, there is provided a container adapted to dispense at least two different liquid hair products comprising: a container body having an interior chamber for separately retaining at least two separate bulk source flowable liquid hair products; at least two flexible air impermeable bulk source bags for retaining a liquid hair product; the bags having dispensing means for dispensing a liquid hair product on demand and being mounted within the body with the body housing the bags; the body having means for permitting the dispensing means of the bags to project externally from the body of the container; the means for permitting the dispensing being spaced apart in the container whereby the liquid hair products may be separately dispensed on demand in a predetermined quantity; and means for partitioning the body into two separate interior chambers with one of the air impermeable bags being mounted in each of the interior chambers.

A still further object of the present invention is to provide an apparatus in which the components are recyclable and reusable.

In greater detail, the container includes a container body having pairs of opposed side and front and rear walls and top and bottom walls, the top wall being hingedly connected to the container to permit access to the interior chamber.

Further, the container may include perforated aperture outlines in one of the front and rear walls. The perforated aperture outlines being adapted to be removed to permit access to the means for permitting dispensing of the contents of each of the bags.

It is another particularly preferred feature that the container additionally includes separate retaining means interiorly of the container body and accessible by the hinged top wall of the container body; the retaining means being adapted to retain hair accessories. In this regard, two separate retaining means may be provided which can be separated interiorly by the means for partitioning the container body.

According to another preferred feature of the present invention, the container body may also include means for mounting the bags interiorly of the container body and within each interior chamber. The means for mounting the bags, in a particularly preferred form, can be angularly positioned within in each interior chamber whereby liquid in each of the bags tends to flow downwardly within the bags to exhaust almost all of the contents.

In a preferred form, the bulk source bags can be comprised of thermoplastic material and may also include an aluminum laminate.

In a further preferred form of the present invention, the dispensing means for dispensing the liquid hair product from the bulk source bags are integral with the bulk source bags. It is a further particularly preferred feature that the dispensing means are manually actuatable in the form of a valve or the like.

In accordance with another embodiment of the present invention there is provided a method of dispensing small amounts of liquid hair products from a bulk source comprising the steps of: providing at least first and second bulk sources of flowable first and second hair products individually packaged; providing openable and closable dispensing means for each of the bulk sources; mounting the bulk sources within a unitary container holding each of the bulk sources; and dispensing predetermined and desired amounts individually from each of the bulk source.

In a particularly preferred feature of the method of the present invention, the individual bulk source packages are comprised of thermoplastic material which may be hermetically sealed.

Another object of the present invention is to provide a container blank for forming a container adapted to dispense separate liquid hair products comprising: a scored and creased blank having a first main rectangularly shaped body panel having a lower margin and a pair of spaced apart parallel sides, and a top margin, one of the parallel sides having a free edge; a first extension panel having a pair of free side edges, a free bottom edge, and a top margin, the latter being foldably connected to the lower margin of the first main body panel;

a second extension panel having spaced apart free side edges and upper and lower margins, the second extension panel being foldably connected along its lower margin to the top margin of the first main body panel; a third extension panel having a pair of spaced apart side margins and top and bottom margins, the third extension panel being foldably connected along its bottom margin to the top margin of the second extension panel; a pair of side extensions associated with the spaced apart parallel side margins of the third extension panel, each of the side extensions having free top and lateral sides; a fourth extension panel having a pair of free side edges and a free top edge, the fourth extension panel having a bottom margin foldably connecting it to the top margin of the third extension panel. The container blank also includes a first rectangularly shaped side panel having a pair of spaced apart parallel side margins and upper and lower margins, a lower extension panel having a pair of spaced apart free side edges and a free lower bottom edge, and a top margin foldably connecting the lower extension panel to the lower margin of the first rectangularly shaped side panel, one of the spaced apart side margins of the first side panel foldably connecting the side panel to the first main body panel, the first rectangularly shaped side panel having an upper extension panel having a pair of spaced apart free side edges and a free top edge, the upper extension panel having a lower margin foldably connecting it to the first rectangularly shaped side panel. There is also included a second main rectangularly shaped body panel having a pair of spaced apart parallel side margins, a top margin and a bottom margin, one of the side margins being foldably connected to the other of the side margins of the first side panel, the second body panel having a lower extension panel associated therewith, the lower extension panel having a pair of free side edges and a free bottom edge and a top margin foldably connecting the extension panel to the lower margin of the second body panel, a first upper extension panel associated with the second body panel having a pair of spaced apart side margins and an upper margin and a lower margin, the lower margin of the first upper extension panel being foldably connected to the upper margin of the second main body panel, and a second upper extension panel having a pair of free side edges and a top edge and a lower margin foldably connecting the second upper extension panel to top margin of the first extension panel. Further, the container blank includes a second rectangularly shaped side panel having a pair of spaced apart parallel side margins, a free top edge, and a lower bottom margin, one of the side margins of the second side panel foldably connecting the second side panel to the second main body panel, the second side panel having a lower extension panel having a pair of spaced apart free side edges and a free lower edge and a top margin foldably connecting the lower extension panel of the second side panel to the lower margin thereof. A partitioning and reinforcing extension is provided, the extension having a first rectangularly shaped reinforcing panel having free top and bottom edges and a pair of spaced apart parallel side margins, one of the side margins foldably connecting the first reinforcing panel to the other of the side margins of the second side panel. The partitioning and reinforcing extension further including a rectangularly shaped partitioning panel having a free lower edge, a pair of spaced apart parallel side margins, one of which foldably connects the partitioning panel to the other of the side margins of the first rectangularly shaped reinforcing panel. Still further, the partitioning and reinforcing extension includes a second reinforcing panel having spaced apart top and bottom free edges, a free side edge and an opposed side margin foldably connecting the second reinforcing panel to the other of the side margins of the partitioning panel.

The present invention utilizes a container which is adapted to retain at least two bulk volume containers or bags which retain the hair products out of contact with atmospheric conditions and at the same time, inhibits or prohibits the chemicals from coming in contact with atmospheric air.

To this end, the bulk chemicals are stored and retained in a flexible, collapsible bag construction of suitable non-reactive material, each bag being provided with dispensing means for permitting dispensing of predetermined quantities of hair chemicals or products on demand. Such bags may be, for example, bags formed of flexible polymeric materials which have a dispensing means located on one face of the bag and which are in contact with the interior contents of the bag with the dispensing means being of an open/closable type.

Typically, the bags may be made of suitable thermoplastic materials such as the various polyolefins or laminates of such materials with one or more other substances such as metal, e.g. aluminum foil. Such bags are known in the art of thermoplastic bags and appropriate materials may be selected by those skilled in the art for different types of hair chemical products.

The container adapted to retain the two or more bulk source bags is preferably of a self-supporting nature, partitioned into separate compartments with each compartment adapted to retain an individual bag of bulk chemical. To this end, the container for retaining the bulk bags will have at least two apertures therein, each aperture being adapted to permit a user to access the dispensing means of the bulk bags contained within the container.

The container blank of the present invention is preferably constructed of suitable board material, such as corrugated board. Preferably, the corrugated board is provided with an outer surface which may be plastic coated. In place of board material, plastic material may also be utilized if desired.

The system of the present invention is particularly adapted to dispense hair components such as hair permanent wave solution and neutralizing solutions, and as well, other hair chemicals used for example in professional salon. Typically, such other solutions may be bleaching agents, colouring agents, chemicals for deep conditioning.

Typically, the system of the present invention will use bulk dispensing for two or more component solutions so that a container may contain two or more bulk chemicals. It is important in using the bags of the present invention that they be of a type, together with the type of dispensing nozzle or valve, that air is excluded from entering into the bags upon dispensing of the chemicals. To this end, preferably, the valves are of the type known in the art which dispense wine from flexible bags.

In preferred embodiments, preferably the dispensing valve for the bulk container is located near the bottom of the bag and in combination with the internal riser platform used in the preferred embodiment of the present invention, the liquid chemicals in the bags will drain to the bottom of the bags so that substantially all of the chemicals may be dispensed as desired from the bags.

Having thus generally described the present invention, reference will now be made to the accompanying drawings illustrating preferred embodiments:

BRIEF DESCRIPTION OF THE DRAWINGS

FIG. 2 is a diagrammatic representation of the riser blank for the container blank of FIG. 1;

FIG. 3 is a perspective view showing the container blank assembled to form the container of the present invention;

DETAILED DESCRIPTION OF THE PREFERRED EMBODIMENTS

Figure 1:
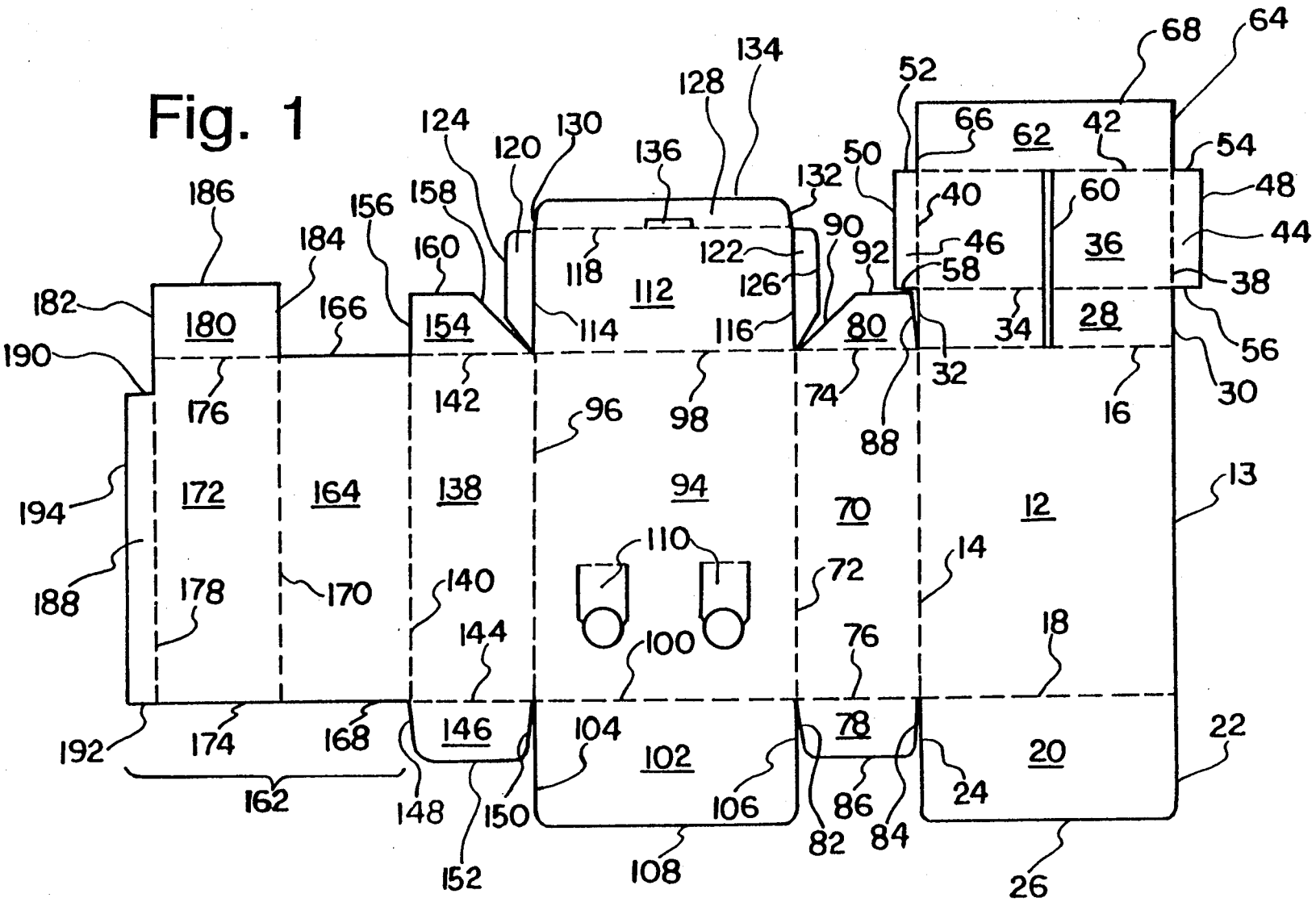
FIG. 1 is a diagrammatic representation of the container blank according to the present invention.

Referring to FIG. 1, there is shown a diagrammatic representation of a scored and creased container blank from which the container of the present invention is formed. The container blank 10 as illustrated in this Figure includes a first rectangularly shaped main body panel 12. The first main body panel 12 includes a free side 13, a side margin 14 which is parallel to and spaced from the free side 13, a top margin 16 and a bottom margin 18. A first generally rectangularly shaped extension panel 20 having a pair of free side edges 22 and 24, a free bottom edge 26. The extension panel 20 is foldably connected to the lower margin 18 of the first main body panel 12. The main body panel 12 also includes a generally rectangularly-shaped second extension panel 28 which is foldably connected to the upper margin 16 of the main body panel 12. The second extension panel 28 includes a pair of spaced apart parallel free side edges 30 and 32 and an upper margin 34. Foldably connected to the upper margin 34 of the second extension panel 28 is a third extension panel 36 which is of a generally rectangular shape. The third extension panel 36 includes a pair of spaced apart parallel side margins 38 and 40 and a top margin 42. A pair of side extensions 44 and 46 are foldably connected to the parallel side margins 38 and 40 of the third extension panel 36. The side extensions 44 and 46 each have one free side edge 48, 50 and free upper edges 52, 54 and lower edges 56, 58. There is also provided a generally vertically oriented, centrally located slot 60 extending from the upper margin 42 of the third extension panel 36 to the upper margin 16 of the main body panel 12. There is provided a fourth extension panel 62 which is foldably connected to the upper margin 42 of the third extension panel 36. The fourth extension panel 62 is also generally rectangularly shaped and includes a pair of spaced apart parallel free side edges 64 and 66 and a free top edge 68.

The container blank further includes a generally rectangularly shaped first side panel 70 which is foldably connected at one side with the side margin 14 of the first main body panel 12. The first side panel 70 includes a side margin 72 which is spaced from and parallel to the side margin 14 of the first main body panel 12. Additionally, the first side panel 70 includes an upper margin 74 and a lower margin 76. The first side panel 70 also includes two extension panels, lower extension panel 78 and upper extension panel 80. Lower extension panel 78 is foldably connected to the lower margin 76 of the first side panel 70 and has a pair of parallel free side edges 82, 84 and a free bottom edge 86. The upper extension panel 80 is foldably connected to the upper margin 74 of the first side panel 70. The upper extension panel 80 has a generally trapezoidally shaped outline and includes a pair of free side edges 88 and 90 and a free top edge 92.

The container blank further includes a second main body panel 94 which is foldably connected to the side margin 72 of the first side panel 70 and includes a parallel side margin 96. The second main body panel 94 also includes an upper margin 98 and a lower margin 100. A lower generally rectangularly shaped extension panel 102 is foldably connected to the lower margin 100 of the second main body panel 94; the extension panel 102 includes a pair of spaced apart parallel free side edges 104, 106 and a free bottom edge 108. The second main body panel 94 additionally includes a pair of spaced apart perforated sections 110 proximate the lower margin 100 but spaced therefrom. A further extension panel 112 is foldably connected to the upper margin 98 of the second main body panel 94. Extension panel 112 has spaced apart parallel side margins 114, 116 and a top margin 118. Additionally extending members 120, 122 extend from each of the side margins 114. 116 and are of a generally trapezoidal shape each having a free edge 124, 126 associated therewith. Extending from the top margin 118 is a further generally rectangularly shaped extension member 128; the extension member 128 has a pair of parallel spaced apart free side edges 130, 132 and a free top edge 134. Extending from the top margin 118 is a cut out tab member 136.

Additionally, the container blank 10 also includes a second side panel 138 of generally rectangular shape, which is foldably connected to the side margin 96 of the second main body panel 94. The second side panel 138 includes a side margin 140, an upper margin 142 and a lower margin 144. A first extension panel 146 is provided and is foldably connected to the lower margin 144 of the second side panel 138. The first extension panel 146 is generally rectangular in shape and includes a pair of parallel spaced part free side edges 148 and 150 and a free lower edge 152. A second extension panel 154 of a generally trapezoidal shape is foldably connected to the upper margin 142 of the second side panel 138 and includes a pair of free side edges 156, 158 and a free top edge 160.

Foldably connected along the side margin 140 of the second side panel 138 is a reinforcing and partitioning extension 162. The reinforcing and partitioning extension 162 comprises: a first reinforcing panel 164 having upper and lower free edges 166, 168 and a side margin 170; a partitioning panel 172 having a free lower edge 174, an upper margin 176 and a side margin 178 and further includes an extension panel 180 foldably connected to the upper margin 176 and having a pair of spaced apart free side edges 182, 184 and a free upper edge 186; and a second rectangular reinforcing panel 188 foldably connected along side margin 178 to panel 172 and having a free upper edge 190, a free lower edge 192 and a free side edge 194.

According to a particularly preferred aspect, the first and second side panels 70 and 138 have a width approximately ½ to ¾ the width of the first and second main body panels 12 and 94, with a particularly preferred width being ½ the width of the first and second main body panels 12 and 94.

It is particularly preferred that reinforcing panel 164 and partitioning panel 172 are the same width as the first and second side panels 70 and 138.

Another preferred feature is that reinforcing panel 188 has a width approximately 1/7 to ¼ the width of partitioning panel 172.

Referring now to FIG. 2, there is shown a typical riser blank 200 to be used in association with the container blank 10. The riser blank 200 comprises a preferably square main panel 202 having a pair of parallel side margins 204, 206, an upper margin 208 and a lower margin 210. Extending from the side margins 204 and 206 are extension panels 212 and 214 which are foldably connected to the main panel 202. The extension panels 212 and 214 have free end edges 213 and 215, respectively. Additionally, there are provided extension panels 216 and 218 which are generally rectangular and are foldably connected to the upper margin 208 and the lower margin 210, respectively, of the main panel 202. The extension panels 212 and 214 preferably include sloped free side edges 224, 226 and 220, 222, respectively. The extension panel 218 includes a free end 219 and free side edges 221 and 223 and in a similar fashion, the extension panel 216 has a free end 205 and free side edges 211 and 213. Preferably the free end 219 of the extension panel 218 includes a hemispherical groove 228 centrally located thereon.

Figure 5:
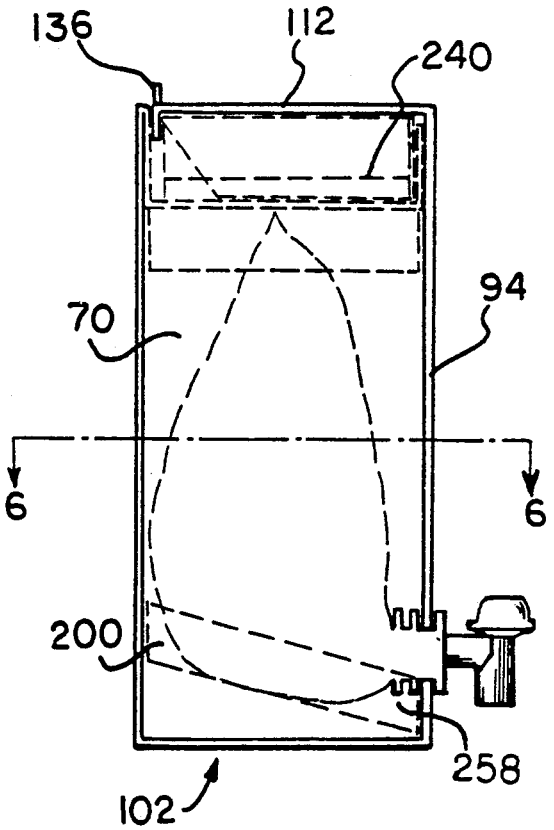
FIG. 5 is a side view of one the individual compartments of the container of the present invention.
Figure 6:
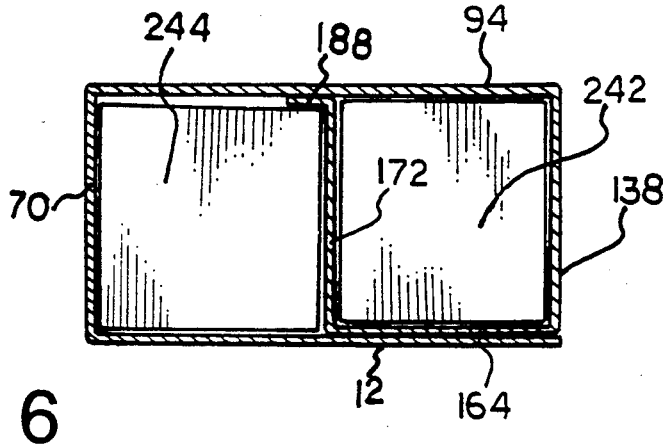
FIG. 6 is a cross sectional view taken along the line 6—6 of FIG. 5 of the container with the bag and dispensing means removed.

The riser blank 200 is formed into a riser member 258 (shown in FIG. 5) by folding the extension panels 212, 214, 216 and 218 along the side margins 206, 204, 208 and 210 Of the main panel 202, respectively.

Having thus generally described the container blank 10 and the riser blank 202 of the present invention, the method of assembly of the container of the present invention will now be described having regard to FIGS. 1, 3, 4, 5 and 6.

In forming the container, with reference to FIG. 1, first main body panel 12 is folded along side margin 14 in order that the first main body panel 12 is perpendicular to first side panel 70. In a similar manner, first side panel 70 is folded along side margin 72 and thus first side panel 70 is perpendicular to second main body panel 94. At this stage, second main body panel 94 and first main body panel 12 are in a parallel relationship with first side panel 70 spacing the first main body panel 12 and the second main body panel 94. Second side panel 138 is folded along side margin 96 so that it is perpendicular to second main body panel 94. The reinforcing and partitioning extension 162 associated with second side panel 138 is then assembled. Reinforcing panel 164 is then folded along side margin 140 such that reinforcing panel 164 is disposed in facing relation and contacts first main body panel 12. Next, reinforcing panel 188 is folded along side margin 178 in such a manner that it is disposed in facing relation and contacts second main body panel 94. As a result of folding reinforcing panels 188 and 164, partition panel 172 perpendicularly oriented with respect to first main panel 12 and second main panel 94 within the compartment defined by the above mentioned folding arrangement.

The formation is secured together by way of suitable adhesives, such as by gluing so that reinforcing panel 164 is adhered to first main body panel 12 and reinforcing panel 188 is adhered to second main body panel 94.

Having thus partially assembled the container, extension 180 of partition panel 172 is then folded downwardly toward the interior of the partially assembled container along upper fold line 176 such that it is in facing relation and contacts partition panel 172. Extension panel 28 of the first main body panel 12 is folded downwardly and interiorly along upper margin 16 such that extension panel 28 is in facing relation and contacts first main body panel 12. Extensions 44 and 50 of extension panel 36 are folded upwardly along side margins 38 and 40. Similarly, extension panel 62 is folded along upper edge margin 42 upwardly to be in contact with interior upper portion of second main body panel 94 thus forming a accessory tray 240 at the top of the container (see FIGS. 3 and 5). The accessory/storage tray 240 is retained in position by folding upper extension panels 80 and 154 of side panels 70 and 138, respectively, downwardly and interiorly so that they are in facing and contacting relationship with their respective side panels 70 and 138; and additionally the accessory/storage tray 240 is frictionally engaged with folded extension 180 of the partition panel 172 being inserted through the slot 60, thereby providing a compartmented storage area.

To form the bottom of the container, lower extension panels 78 and 146 of side panels 70 and 138, respectively, are folded along lower margins 76 and 144 inwardly so that extension panels 78 and 146 are perpendicularly disposed with side panels 70 and 138 respectively. Following this, extension panel 20 of first main body panel 12 is folded in a similar fashion along lower fold line 18 and finally, extension panel 102 of second main body panel 94 is folded along lower margin 100 so that it is in contacting and facing relationship with extension panel 20 at which point it may be adhered thereto by any suitable means thus providing the bottom of the container.

In this manner of construction, the partition panel 172 forms a pair of compartments 242 and 244 (shown in FIGS. 3 and 6) within the interior of the container thus assembled.

Having thus assembled the riser blank 202 into a riser member 258 and the container 10, the riser member 258 is placed within the interior of the individual compartments (see for example compartment 242 in FIG. 3) at the bottom thereof in such a manner that the hemispherical groove 228 of extension panel 218 of the riser member 258 is so that it registers with the perforated sections 110 of the second main body panel 94.

Figure 4:
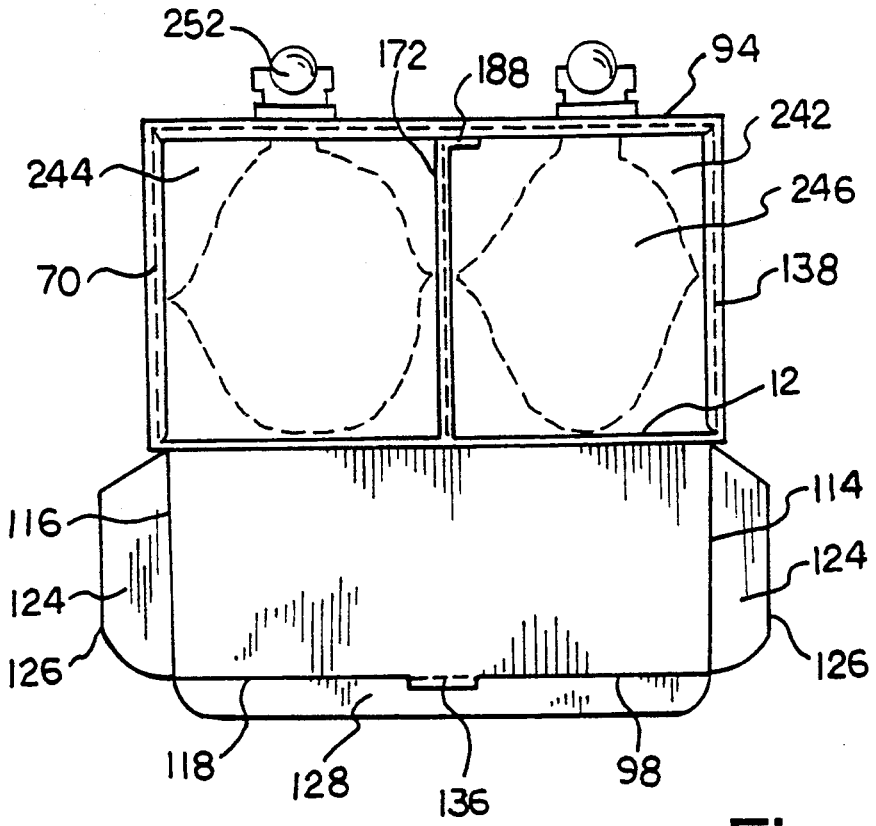
FIG. 4 is a top plan view of the container of the present invention exposing the interior of the container.

Referring now to FIG. 4, shown is a top plan view of the container as above assembled, having bulk dispensing plastic bags 246 and 248 disposed within the individual compartments 242 and 244 of the container. The bulk dispensing bags 246 and 248 may contain separate bulk source flowable liquid hair products and preferably the bags are composed of the known components used in the manufacture of these, such as thermoplastic material having an aluminum lamination. The bags may also have conventional manually actuatable dispensing valves 250, 252. The perforated outlines 110 of the second main body panel 94 are "punched out" thus providing apertures therein from which the dispensing valves 250 and 252 of the bags 246 and 248 may project. The individual bags 246 and 248 are inserted into the individual compartments 242, 244 of the container in such that they rest on the riser member 258 and so that the dispensing valves 250 and 252 protrude outwardly from the above described apertures and are further supported by the hemispherical groove 228 of the riser member 258. As the riser member 258 rests in an angled position within the compartment 242, the fluid within the bag 248 would be constantly urged towards the dispensing means 252 thereby permitting ready flow of fluid even when the fluid level in the bag is extremely low. The bag 246 would be set up within compartment 242 in a similar manner as that described above utilizing a similar riser member.

Once the bags 246 and 248 have been inserted into the individual compartments 242 and 244 as described above and the valves 250 and 252 are in place as noted above, the extension panel 112 of the second main body member 94 and its extensions 120, 122 and 128 are folded inwardly along their margins 98, 114, 116 and 118, respectively and the extension panel 112 is then pressed downwardly so that extensions 120, 122 and 128 slide into slots which have been previously formed by the construction of the container.

Figure 7:
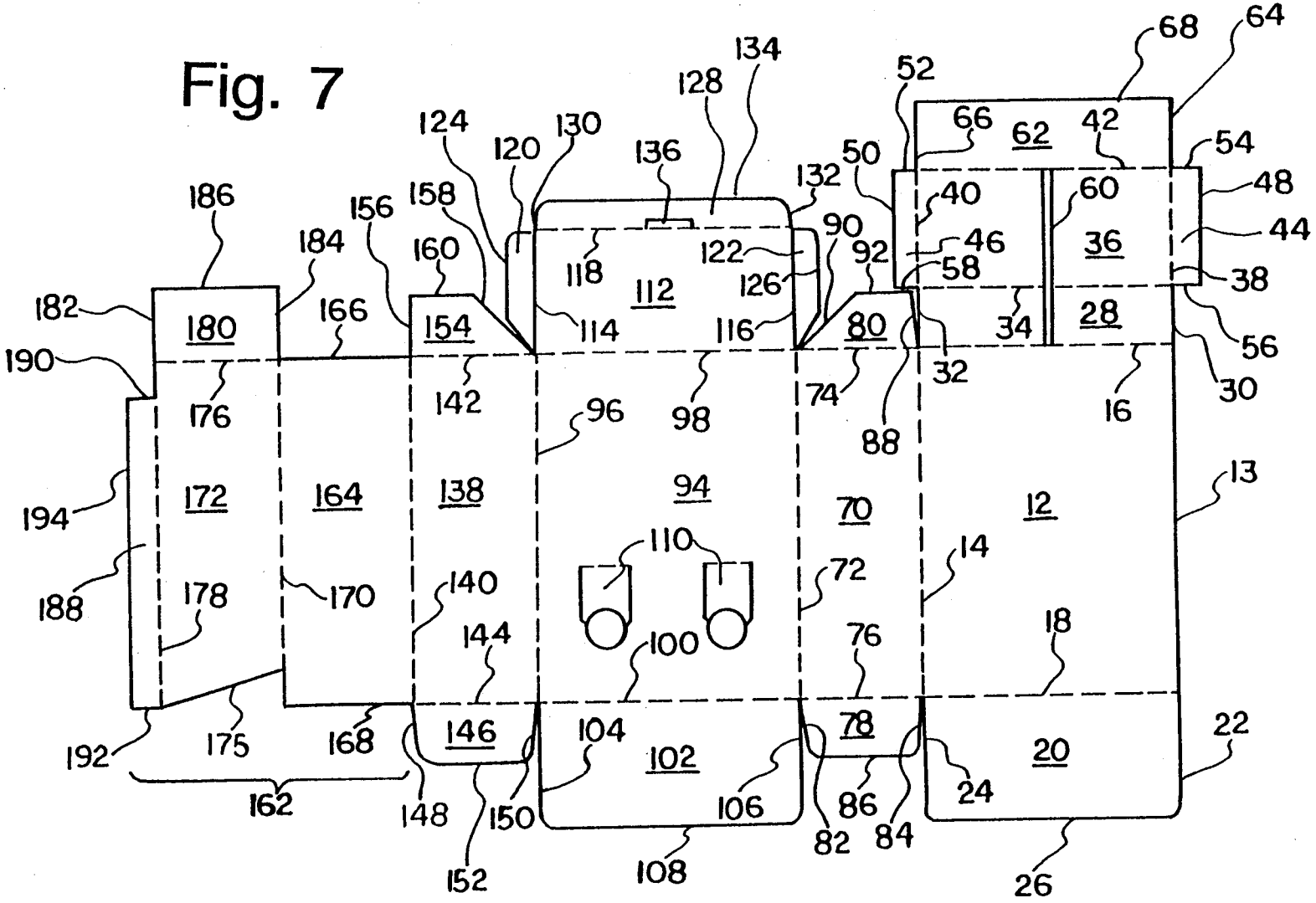
FIG. 7 is a diagrammatic representation of a container blank according to another embodiment of the present invention.

Referring to FIG. 7, shown is an alternate embodiment of the container blank 10 in which similar members apply to similar elements from previous Figures. In this embodiment, partition panel 172 includes an upwardly and angularly inclined lower free edge 175 which tapers upwardly from side margin 178 to side margin 170 of reinforcing panel 164. The container 10, according to this embodiment, permits the use of an alternate riser such as that shown in FIG. 8.

Figure 8:
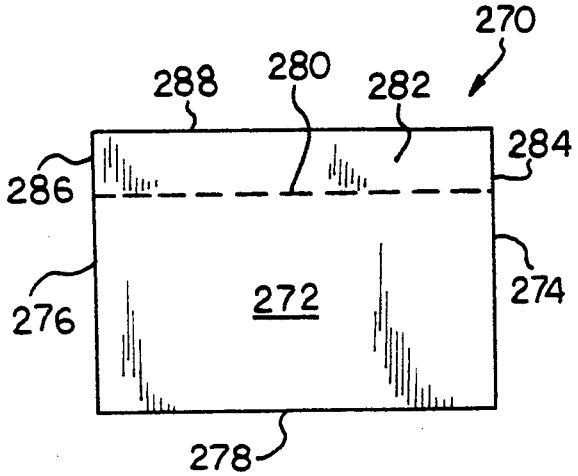
FIG. 8 is a diagrammatic representation of an alternate embodiment of the riser blank.

Referring now to FIG. 8, shown is a riser blank 270 to be used in association with container blank 10 of FIG. 7. The riser blank 270 preferably comprises a generally rectangular main panel 272 which includes a pair of spaced apart opposed free edges 274, 276 and a lower edge 278. An upper margin 280 includes an extension panel 282 extending therefrom and foldably connected to the main panel 272. The extension panel 282 is preferably generally rectangular with opposed free side edges 284, 286 and a free upper edge 288. The width of the extension 282 may be from about $\frac{1}{8}$ to about $\frac{3}{4}$ the width of the panel 272 and more desirably about $\frac{1}{4}$. The riser blank 270 is formed into a riser member by folding the extension panel 282 along top margin 280 of main panel 272.

Figure 9:
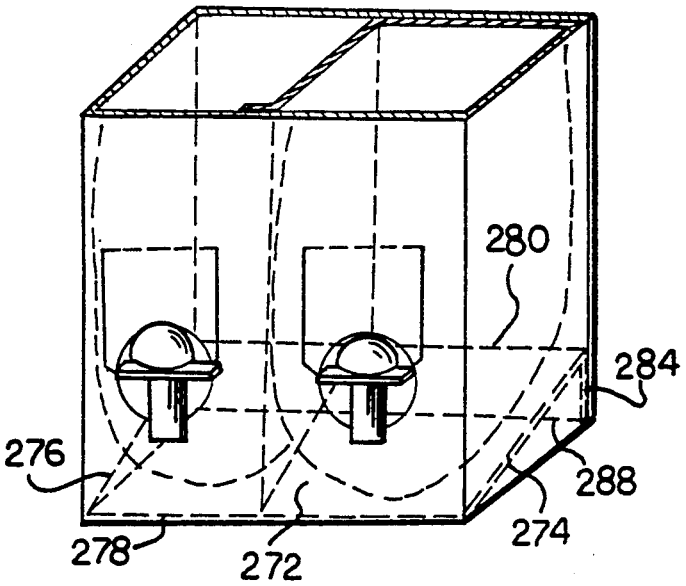
FIG. 9 is a perspective view of the container formed from the blank of FIG. 1 having the riser blank of FIG. 8 illustrated in situ.

FIG. 9 illustrates the riser blank 270, as folded, in position within the container formed from the blank 10 of FIG. 7. As is illustrated in the Figure, the riser 270 is generally elevated by extension panel 284 which is in facing relation to the inside of main body panel 12 and in contact with the inside surface of extension panel 20. The riser 270 while in position then tapers downwardly from main body panel 12 to the second main body panel 94. In such an arrangement, the riser 270 provides an inclined surface on which the dispensing bags 246, 248 rest. This allows the liquid material therein to be constantly urged towards the dispensing spouts 250, 252.

Figure 10:
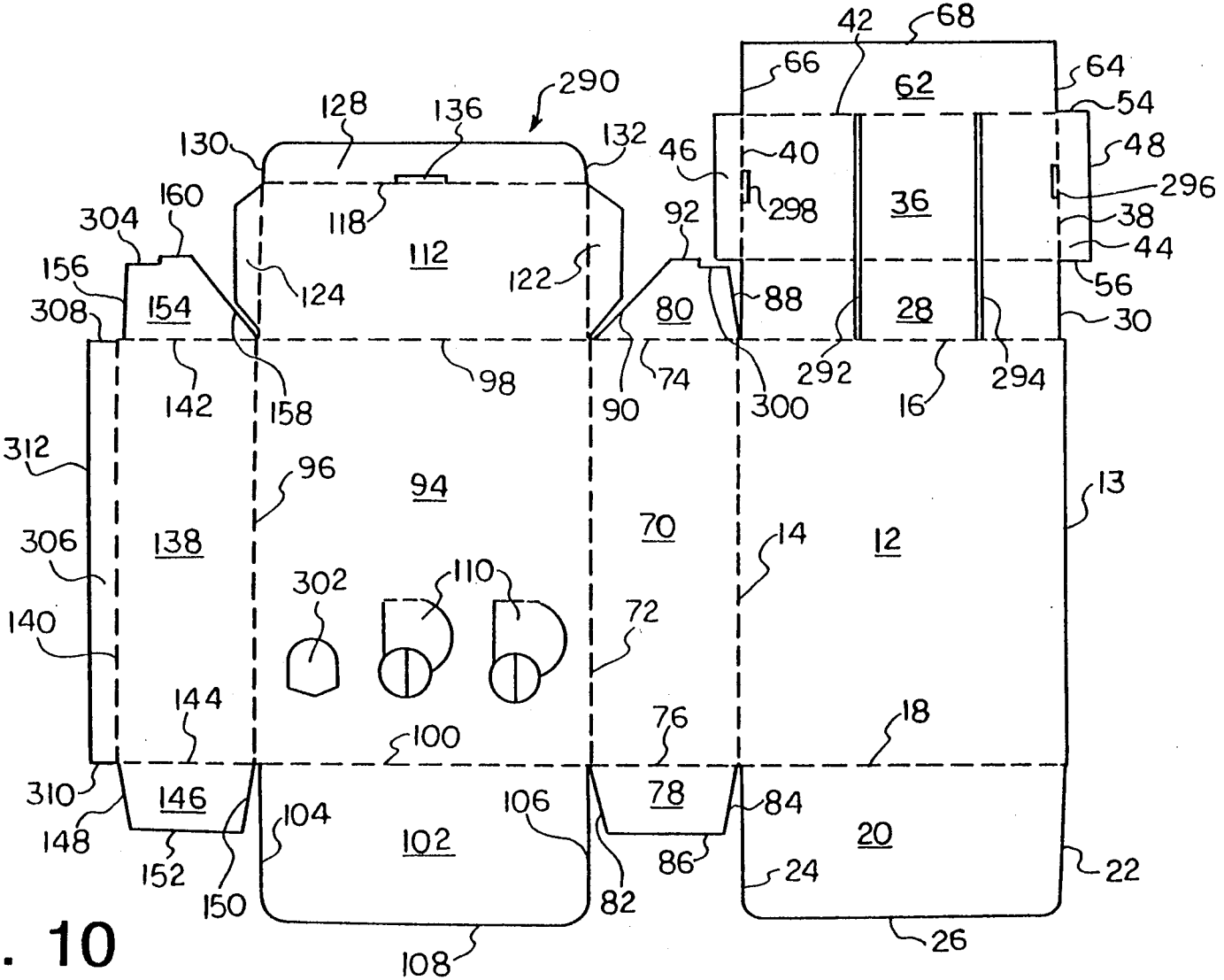
FIG. 10 is a diagrammatic representation of yet another embodiment of the container blank of the present invention.

Referring now to FIG. 10, shown is a diagrammatic representation of a further alternate embodiment of the present invention. The scored and creased blank 290 shares some common features with the blanks in FIGS. 1 and 7 and similar numerals will indicate the same.

In this embodiment, the reinforcing panel 164 and partitioning panel 172 are removed from the blank 10. Referring to the main body panel 12 of this embodiment, a pair of spaced apart slots 292, 294 extend from the upper margin 42 of the third extension panel 36 to the upper margin 16 of the main body panel 12. Further, side extensions 44 and 46 of extension panel 36 preferably each include cut-out tab members 296, 298 extending from margins 38 and 40, respectively. Upper extension panel 80 having free side edges 88 and 90 preferably includes a cut-out segment 300 on top free edge 92 extending from side edge 88 to slightly inwardly thereof. Similar dimensions for the various extensions apply from the description of FIG. 1.

The second main body panel 94 further, in the embodiment, includes an additional perforated section 302 spaced inwardly and upwardly from side margin 96 and lower margin 100, respectively, of the second main body panel 94. The section 302 is preferably in line with and adjacent perforated section 110.

Turning to second side panel 138, it is preferred that the upper extension panel 154 includes a cut-out segment 304 in top free edge 160 extending from side edge 154 and slightly inwardly thereof. The side panel 138 further includes a reinforcing panel 306 foldably connected along side margin 140 of panel 138 having a free upper edge 308 and free lower edge 310 with free side edge 312.

Figure 11:
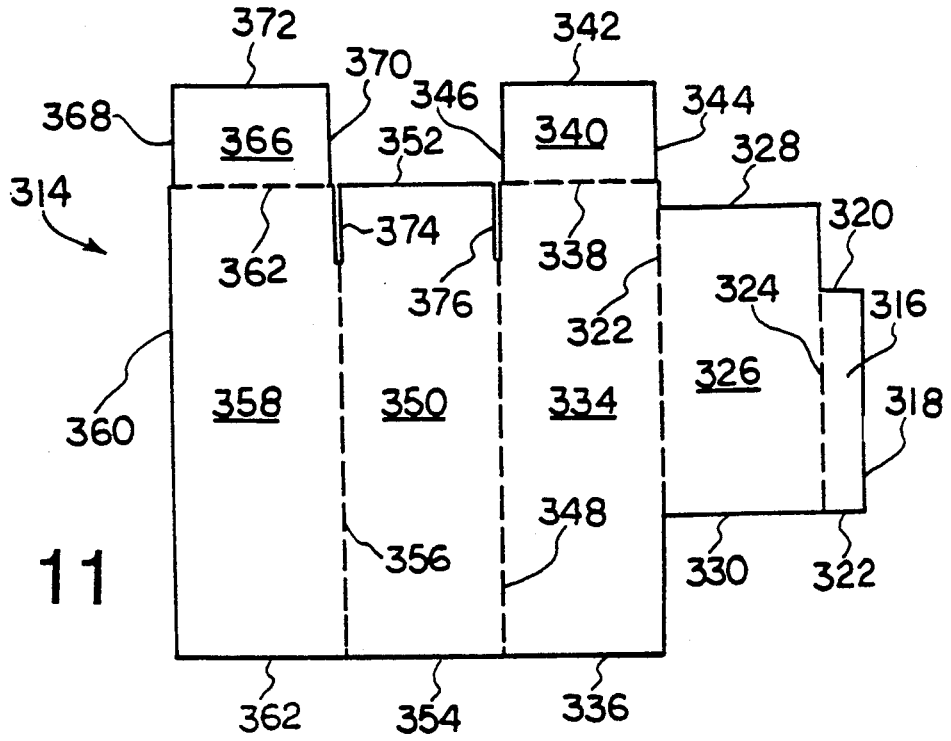
FIG. 11 is a diagrammatic representation of a divider blank for use in the container blank illustrated in FIG. 10.

Referring now to FIG. 11, shown is a diagrammatic representation of a scored and creased blank 314 for use within the blank 290 illustrated in FIG. 10. The blank 314 includes a first generally rectangular reinforcing panel 316 having a free side edge 318, upper edge 320 and lower spaced apart edge 322. It is preferred that the side edge 324 of reinforcing panel 318 is foldably connected therealong with main body panel 326.

The main body panel 326 includes upper edge 328 and spaced apart lower edge 330. A first generally rectangular side panel 334 is preferably foldably connected along side margin 332 common to panels 326 and 334 and is from about $\frac{1}{4}$ to about the equivalent height of panel 334 and more desirably about $\frac{1}{2}$ the height. Panel 326 is approximately centrally located along margin 332 of panel 334. Panel 334 includes a lower edge 336 and a spaced apart upper margin 338 to which there is foldably connected a generally rectangular extension panel 340 having a free upper edge 342 and spaced apart side edges 344 and 346. A parallel side margin 348 of panel 334 is foldably connected to a rectangular second side panel 350 having a free upper edge 352 and spaced therefrom, a free lower edge 354. It is preferred that a third generally rectangular side panel 358 be foldably connected along side margin 356 common to panels 350 and 358. Panel 358 includes a free side edge 360 parallel to margin 356, a free lower edge 362 and an upper edge 364 foldably connected to a generally rectangular extension panel 366. The extension panel 366 includes spaced apart edges 368, 370 and a free upper edge 372.

Returning to panel 352, it is particularly preferred that cut-out segments 374, 376 extend downwardly from upper edge 352.

It is preferred that panels 326, 334, and 350, 358 be the same width and that panel 334, 350 and 358, be the same length.

Figure 12:
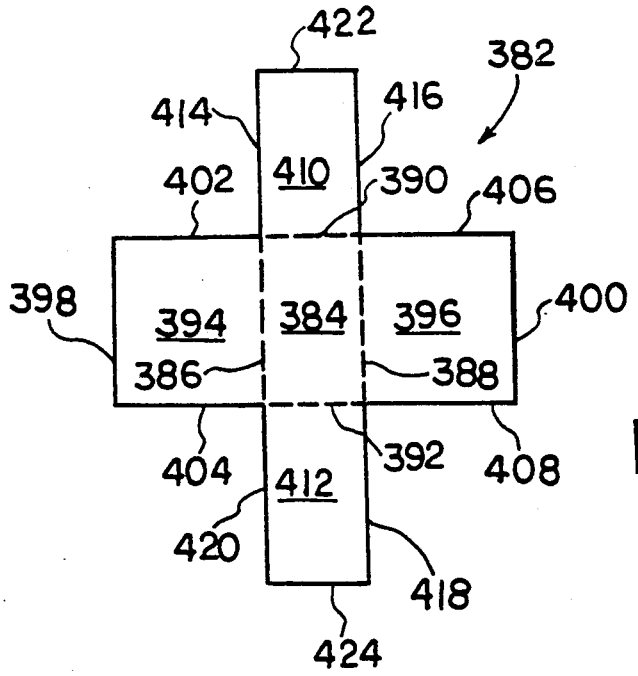
FIG. 12 is a diagrammatic representation of a riser blank according to yet another embodiment of the present invention.

Referring to FIG. 12, there is shown a further riser blank 382 to be used in association with the container blank illustrated in FIG. 10 in addition to those herein previously described in FIG. 2. The riser blank 382 comprises a preferably rectangular main panel 384 having a pair of parallel side margins 386, 388, an upper margin 390 and a lower margin 392. Extending from the side margins 386 and 388 are extension panels 394, 396, respectively, which are generally square and foldably connected to the main panel 384 along margins 386, 388. The extensions 394 and 396 have free end edges 398, 400, free side edges 402, 404 and 406, 408, respectively.

The riser blank 382 is formed into a riser member (FIG. 13) by folding the extension panels 394, 396, 410, 412 along side margins 386, 388, 390 and 392 of the main panel 384, respectively.

In forming the container, with reference to FIG. 10, generally first main body panel 12 is folded along side margin 14 as described for the blank 10 in FIG. 1. The same sequence is followed as previously outlined for forming the container, but extension 306 is placed in facing relation adjacent the side 13 of main body panel 12 to complete the formed body of the container.

Suitable means e.g. adhesives etc. join the extension 306 with panel 12.

The blank 314 is assembled by folding panel 316 along margin 324 for perpendicular orientation to panel 326. Similarly, panel 350 and 358 are folded along their respective margins to facilitate the formation of an elongated rectangular box. Extension 316, in such an arrangement, is placed in facing relation with panel 358 adjacent the side 360 thereof and adhered etc. therewith. In addition, extensions 340 and 366 are folded downwardly along margins 338 and 362 to be in facing relation with panels 334 and 358 respectively; the extensions 340 and 366 are then preferably adhered thereto.

Having thus formed the blank 314 into a divider, the divider is then situated within the partially assembled container 10 made from blank 290.

This is achieved by inserting the divider into the container 10 such that panel 326 is in facing relation with the interior surface of second main body panel 94 and that panel 350 is similarly positioned with panel 12. It is preferred that 326 and 350 be adhered to their respective body panels and that panel 350 be centered on body panel 12 between slots 292 and 294 of extensions 28 and 36.

In this arrangement, top margins 338 and 362 register in alignment with slots 292 and 294 and the divider thus divides the interior of the container into three separate compartments.

The remaining assembled steps are such as those described herein previously for the blank of FIG. 1.

Figure 13:
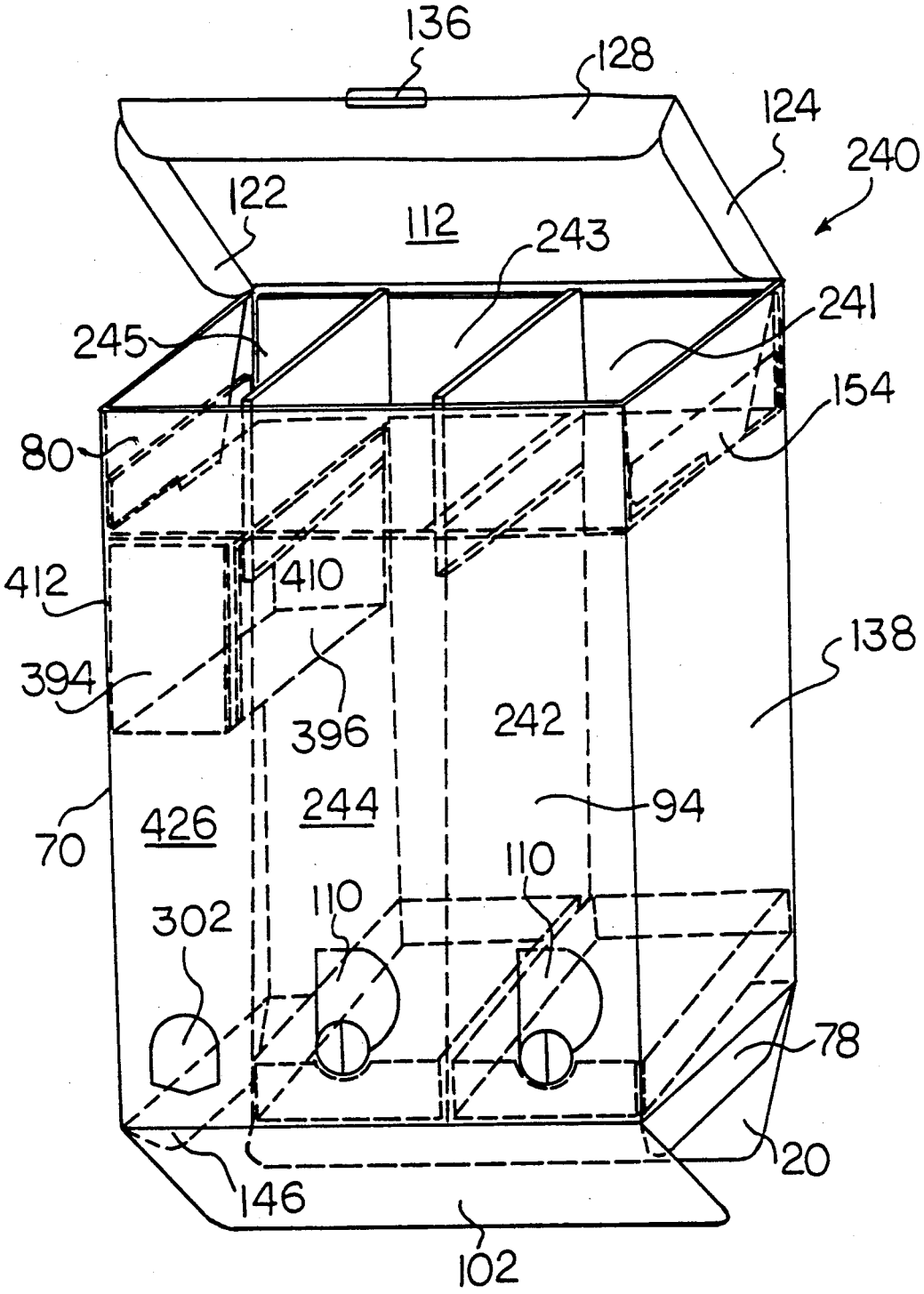
FIG. 13 is a perspective view of the container formed from the blank illustrated in FIG. 10.

Referring to FIG. 13, shown is a perspective view of the assembled container having compartments 242, 244 and 426 and a top storage tray 240 subdivided into three sections 241, 243 and 245. In the formed structure, the tray 240 is secured by cut-out segments 300 and 204 of extensions 80 and 154, respectively, engaging cut-outs 296 and 298 of extensions 44 and 46.

As those skilled in the art would realize the above referred to preferred illustrated dimensions, details and components can be subjected to substantial variation, modification, change, alteration, and substitution without affecting or modifying the function of the illustrated embodiments. Although embodiments of the invention have been described above, it is not limited thereto, and it will be apparent to persons skilled in the art that numerous modifications and variations form part of the present invention insofar as they do not depart from the spirit, nature and scope of the claimed and described invention.

We claim:

1. A method of dispensing small amounts of liquid hair products from a bulk source comprising the steps of:

providing at least first and second bulk sources of flowable first and second hair products individually packaged;

providing openable and closable dispensing means for each of said bulk sources;

mounting said bulk sources within a unitary container holding each of said bulk sources;

dispensing predetermined and desired amounts individually from each of said bulk sources, and providing a hinged integral recessed accessory tray at a top end of said container.

2. A method as defined in claim 1, wherein said first and second bulk sources comprise a hair permanent solution and a neutralizing solution.

3. A method as defined in claim 1, wherein said individual packaged bulk sources comprises packages thermoplastic material.

4. A method as defined in claim 3, wherein said thermoplastic material includes an aluminum lamination.

5. A method as defined in claim 1, wherein said bulk sources are hermetically sealed.

6. A method as defined in claim 1, wherein said dispensing means are integral with said individual bulk sources.

7. A method as defined in claim 1, wherein said dispensing means are manually actuatable valves.

8. A container adapted to dispense at least two different liquid hair products comprising:

a container body having an interior chamber for separately retaining at least two separate bulk sources of flowable liquid hair products, said at least two separate bulk sources comprising flexible air impermeable bulk source bags, said bags having dispensing means for dispensing the liquid hair product on demand and being mounted within said body with said body housing said bags, said body having means for permitting said dispensing means of said bags to project externally from the body of said container, said means for permitting said dispensing means to project externally being spaced apart in said container whereby said liquid hair products may be separately dispensed on demand, means for partitioning said interior chamber into at least two separate interior chambers with one of said air impermeable bags being mounted in each of said interior chambers;

said container including a container body having pairs of opposed side walls and front and rear walls and top and bottom walls, said top wall being integral with and hingedly connected to said container to permit access to said interior chamber, and said top wall extending between said side walls and front and rear walls, below a top edge of said side walls and front and rear walls to form an accessory tray.

9. A container as defined in claim 8, wherein said means for permitting said dispensing means to project include perforate aperture outlines in one of said front and rear walls, said perforated apertures outlines being adapted to be removed to permit access to said dispensing means for dispensing the products of each of said bags.

10. A container as defined in claim 8, wherein said accessory tray is divided into two sections separated interiorly by said means for partitioning.

11. A container as defined in claim 8, wherein said container includes means for mounting said bags interiorly of said container body and within each of said separate interior chambers, said means for mounting said bags being angularly positioned within each said separate interior chambers whereby liquid in each of said bags tends to flow downwardly within said bags.

12. A container as defined in claim 8, wherein said air impermeable bags are comprised of thermoplastic material.

13. A container as defined in claim 12, wherein said thermoplastic material includes an aluminum lamination.

14. A container as defined in claim 8, wherein said two separate bulk sources of flowable liquid hair products are a hair permanent solution and a neutralizing solution.

15. A container as defined in claim 8, wherein said dispensing means are integral with said bags.

16. A container as defined in claim 8, wherein said dispensing means are manually actuatable valves.

* * * * *